US005122810A

United States Patent [19]

Nisbet et al.

[11] Patent Number: 5,122,810

[45] Date of Patent: Jun. 16, 1992

[54] FEED WAVEGUIDE WITH FERRITE ROD POLARIZER AND STEPPED DIELECTRIC SUPPORT FOR MATCHING

[75] Inventors: William T. Nisbet, South Queensferry; Robert M. Ferguson, Edinburgh; Andrew P. Baird, Bo'Ness, all of Scotland

[73] Assignee: Racal-MESL Limited, Midlothian, Scotland

[21] Appl. No.: 397,383

[22] Filed: Aug. 23, 1989

[30] Foreign Application Priority Data

Aug. 24, 1988 [GB] United Kingdom ..... 8820097

[51] Int. Cl.[5] ..... H01Q 13/00; H01P 1/17

[52] U.S. Cl. ..... 343/756; 343/786; 343/787; 333/21 A; 333/24.3

[58] Field of Search ..... 343/786, 756, 787; 333/24.3, 21 A, 34

[56] References Cited

U.S. PATENT DOCUMENTS

| | | | |
|---|---|---|---|
| 2,909,738 | 10/1959 | Davis et al. | 333/24.3 |
| 2,933,731 | 4/1960 | Foster | 343/756 |
| 3,084,295 | 4/1963 | Rosen | 333/24.3 |
| 3,089,104 | 5/1963 | Allen | 343/756 |
| 3,130,379 | 4/1964 | Hadly | 333/24.3 |
| 3,546,634 | 12/1970 | Dubrowsky | 333/21 A |
| 3,698,008 | 10/1972 | Roberts et al. | 333/24.3 |
| 3,760,300 | 9/1973 | Leahy | 333/24.3 |
| 4,353,041 | 10/1982 | Bryans | 333/21 A |
| 4,434,426 | 2/1984 | Gaglione et al. | 333/24.3 |
| 4,539,681 | 9/1985 | Hudspeth et al. | 333/24.3 |
| 4,821,002 | 4/1989 | Luly | 343/756 |

FOREIGN PATENT DOCUMENTS

| | | | |
|---|---|---|---|
| 1182314 | 11/1964 | Fed. Rep. of Germany . | |
| 1142632 | 9/1957 | France . | |
| 549826 | 10/1956 | Italy | 333/24.3 |
| 753368 | 7/1956 | United Kingdom . | |
| 804518 | 11/1958 | United Kingdom . | |
| 850054 | 9/1960 | United Kingdom . | |
| 869785 | 6/1961 | United Kingdom | 333/24.3 |
| 936025 | 9/1963 | United Kingdom . | |
| 1166402 | 10/1969 | United Kingdom . | |

OTHER PUBLICATIONS

Zinburg, "Circular Polarization System for Suppression of Rain Echoes", Luftfahrttechnik, Raumfahrttechnik 9 (1963) No. 2., Feb.

*Primary Examiner*—Michael C. Wimer
*Attorney, Agent, or Firm*—Leydig, Voit & Mayer

[57] ABSTRACT

An antenna arrangement for receiving television signals from a satellite comprises a parabolic dish which collects the signals and feeds them through a feedhorn, then through a polarization switch and to a low noise block to the receiver. The polarization switch comprises a ferrite rod supported in a dielectric holder within a circular waveguide. The ferrite rod is surrounded by a solenoid coil which is energizable to rotate the plane of polarization of the signals passed along the waveguide, so as to enable the switch to select either horizontally or vertically polarized signals. The current in the coil is switchable between two values, one having a predetermined magnitude in one direction through the coil and the other having the same predetermined magnitude but in the opposite direction through the coil. The current levels are seleced such that the corresponding angular positions for the plane of polarization are +45° relative to the datum position for the polarization plane and −45° with reference to this datum position. The dielectric holder has a stepped configuration so as to match the loaded waveguide to the empty waveguide.

8 Claims, 4 Drawing Sheets

FEED WAVEGUIDE WITH FERRITE ROD POLARIZER AND STEPPED DIELECTRIC SUPPORT FOR MATCHING

BACKGROUND OF THE INVENTION

The invention relates to arrangements responsive to polarised radio signals such as radio transmissions from satellites such as television transmissions.

In order to maximise bandwidth utilisation, signals transmitted via a satellite may be transmitted with more than one sense of polarisation; for example, signals representing one television channel may be transmitted (at a particular frequency) with one mode of linear polarisation, say, horizontal polarisation, whereas signals representing another television channel may be transmitted at the same or a near by frequency but with (in this example) vertical polarisation. Similarly, the two senses of circular polarisation can be used, respectively, instead of the two modes of linear polarisation. In order for an antenna to be set to receive signals representing a particular television channel, it is therefore necessary for the antenna to be switchable into a state in which it can receive signals having the corresponding polarisation state.

BRIEF SUMMARY OF THE INVENTION

According to the invention, there is provided a polarisation switching arrangement responsive to polarised radio signals and capable of selecting signals having either one of predetermined states of linear polarisation, comprising a waveguide, dielectric support means axially and dielectrically supporting a ferrite rod, electrically energisable field generating means for generating a magnetic field directed axially along the ferrite rod, and energisation means for controlling the energisation of the field generating means so as to switch the plane of linear polarisation in the waveguide between two positions which are orthogonal to each other, the dielectric support means comprising a dielectric holder directed axially of the waveguide and whose opposite axial ends are of stepped configuration so as to compensate for the loading effect of the ferrite rod on the waveguide.

According to the invention, there is also provided a polarisation switching arrangement responsive to polarised radio signals and capable of selecting signals having either one of predetermined states of linear polarisation, comprising means defining a waveguide, a ferrite rod completely filling the waveguide over the length of the ferrite rod, electrically energisable field generating means for generating a magnetic field directed axially along the ferrite rod, and energisation means for controlling the energisation of the field generating means so as to switch the plane of polarisation in the waveguide between two positions which are orthogonal to each other.

According to the invention, there is also provided an arrangement capable of receiving incoming polarised radio signals which may have any one or more of the following states of polarisation, that is to say circularly polarised in either sense and linearly polarised in either of two orthogonal planes, comprising polarisation means responsive to the incoming signals and switchable to select such signals having any one of the said states of polarisation and producing a corresponding output signal but always having the same predetermined one of the planes of linear polarisation.

In this specification and its claims, the term "ferrite" includes any other material achieving the same effect as ferrite within the context of the arrangements and methods referred to.

DESCRIPTION OF THE DRAWINGS

Antenna arrangements embodying the invention and for receiving signals from a satellite will now be described, by way of example only, with reference to the accompanying diagrammatic drawings in which.

DESCRIPTION OF PREFERRED EMBODIMENTS

Figure 1:
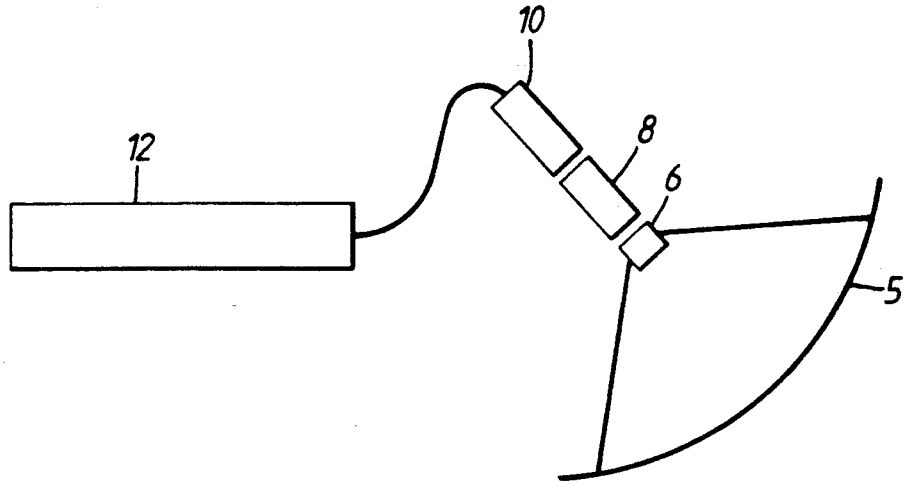
FIG. 1 shows one of the antenna arrangements in diagrammatic form.

As shown in FIG. 1, the antenna arrangement comprises a parabolic dish antenna 5 focussing the received signals onto a suitable feedhorn 6. Such signals are those transmitted or transponded by a satellite and may be horizontally or vertically polarised; both horizontally and vertically polarised signals will be received by the dish at the same time.

The feedhorn 6 collects the signals and propagates them into a circular waveguide (not shown) which feeds them to a polarisation switch 8. In a manner to be described in more detail below, the polarisation switch can be set into either of two states in which it respectively selects the horizontally and the vertically polarised signals. The selected signals will lie in any frequency channel (within the total bandwidth used), and with the selected plane of polarisation. These signals are passed to a low noise block down-converter 10 which selects the particular frequency channel and converts the signal into suitable form for transmission to a receiver 12 from where they are passed to the conventional television set.

Figure 2:
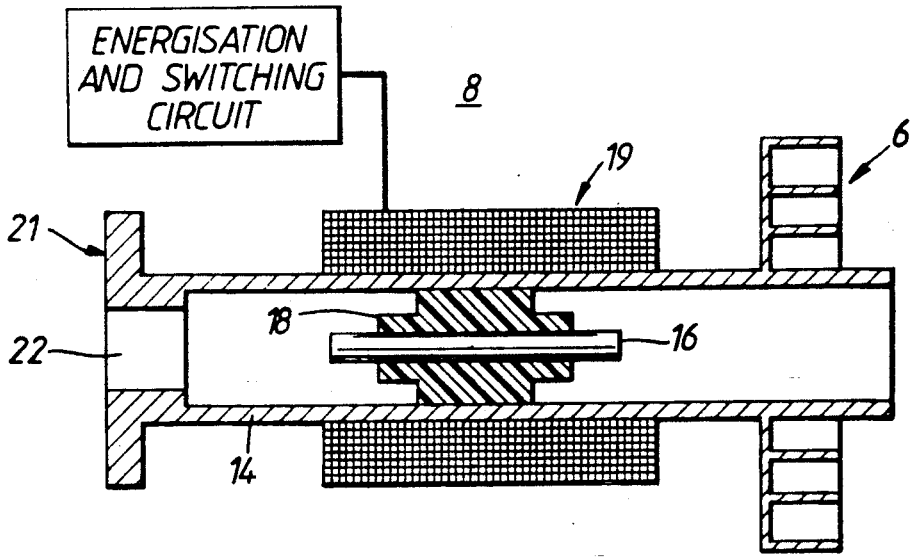
FIG. 2 is a cross-section through a rotator (plus an integral feedhorn and adaptor) which may be used in the antenna arrangement for converting between horizontally and vertically polarised signals.

The polarisation switch is shown in more detail in FIG. 2. As shown, it comprises a circular waveguide 14 in which is mounted a ferrite rod 16. The ferrite rod is mounted in the waveguide by means of a shaped dielectric holder 18 formed from a low dielectric constant material such as polytetrafluoroethylene (PTFE) or expanded polystyrene. A solenoid winding 19 is wound around the exterior of the waveguide in alignment with the ferrite rod 16. The feedhorn 6 (see FIG. 1) is shown as being mounted at the input end of the waveguide 14.

The dielectric holder 18 is formed with a stepped configuration as shown so as to match the ferrite-loaded waveguide to the empty waveguide.

In order to feed the output from the polarisation switch 8 to the low noise block 10, a rectangular waveguide is connected at the end 21 of the switch. The circular waveguide 14 includes a shaped portion 22 to provide suitable transition between the circular cross-section of the waveguide 14 and the rectangular cross-section waveguide connected to the end 21. The feedhorn is shown generally at 6.

As indicated above, the purpose of the polarisation switch 8 is to select either horizontally or vertically polarised signals for feeding to the low noise block 10 and, eventually, to the television receiver. The polarisation switch 8 operates using Faraday rotation. Its switching action is achieved by reversing the direction of the magnetic field applied axially along the ferrite rod 16. Thus, in order to select signals in one of the two planes of polarisation, the solenoid winding 18 is energised with current of one polarity and of such magnitude as to rotate the plane of polarisation by 45° in one angular direction relative to the datum position of the plane of polarisation, that is, the position of the plane of polarisation with zero current. In this way, the polarisation switch 8 is set into one of its two settings and (according to the physical orientation of the arrangement) selects either the horizontally or vertically polarised signals. In order to switch the polarisation switch into its opposite setting, to select the other polarised signals, the current in the coil 18 is altered so as to have the same magnitude as previously but in the opposite direction. The plane of polarisation is now rotated through the datum angular position (obtaining with zero current) and thence to a position at 45° on the other side of the datum position.

As compared with an arrangement in which the plane of polarisation is switched between zero and +90°, the arrangement described in which the plane of polarisation is switched from +45° to −45° is advantageous in that the length of the ferrite rod 16 is halved (alternatively, the length of the ferrite rod can be the same as with an arrangement where the plane of polarisation is switched between 0° and 90° and the current can instead be halved). In addition, the reduced rotation (the maximum rotation is 45° from the datum setting) is less frequency-dispersive; that is, a single current level is sufficient to obtain the required rotation over the complete frequency range. The reduced-length ferrite rod allows a lower insertion loss and this improves the noise performance of the system. Furthermore, the size, weight and cost of the polarisation switch can be reduced.

The solenoid winding 19 can be wound separately, then fitted over the waveguide, the flange 20 or feedhorn being removable for this purpose.

The stepped arrangement of the dielectric holder 18 is advantageous because it is relatively easy to manufacture and avoids the need for tapering the ends of the ferrite rod which involves an expensive machining operation. Such advantages can be achieved not only with the polarisation switch shown in FIG. 2 but also with other types of polarisation switch such as those in which the plane of polarisation is switched between zero and 90°.

Figure 3:
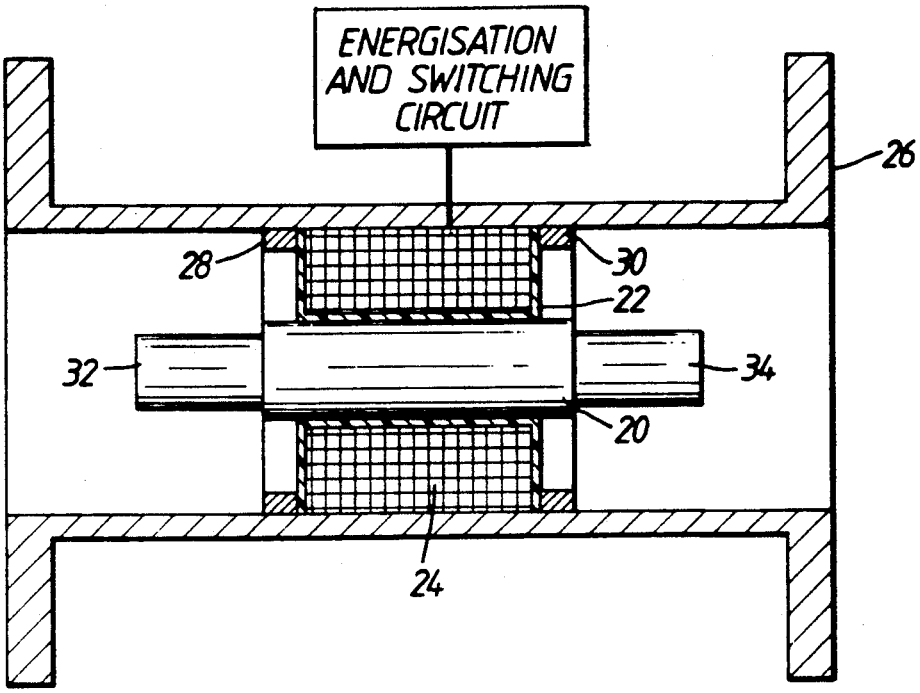
FIG. 3 is a cross-section through a modified form of the rotator of FIG. 2.

The polariser of FIG. 3 is a modified form of that shown in FIG. 2. As shown in FIG. 3, it comprises a ferrite rod 20 which corresponds to the ferrite rod 16. The rod 20 is a close fit within a circular former 22 around which is wound a coil 24 corresponding to the coil 19 of FIG. 2. The arrangement is locked in position in a circular waveguide housing 26 or feedhorn by metal rings 28 and 30.

The ferrite rod 20 is provided with a metallised coating on its cylindrical surface. Instead, the former 22 is either made of metal or of metallised material, such as metallised plastics. Therefore, the metallisation on the ferrite rod or the metal or metallised former constitutes the actual waveguide which is thus of reduced diameter as compared with the waveguide 14 of FIG. 2.

Ceramic dielectric impedance transformers 32 and 34 are provided to couple the waveguide into the input and output ends of the housing 26.

The operation of the rotator of FIG. 3 corresponds with that described with reference to FIG. 2.

The arrangement of FIG. 3 is advantageous over that shown in FIG. 2 because its frequency dispersion is less thus allowing a single current level to provide the required rotation across the complete frequency band. In addition, the structure is compact, thus reducing size and weight. Manufacturing cost is lower. However, it may have a slightly higher insertion loss (for example, 0.1 dB higher than the arrangement of FIG. 2).

In the form of FIG. 3, the ferrite rod, former and coil combination forms an insert which can be press-fitted into a suitable feedhorn of correct dimension using the rings 28 and 30.

The rotators described with reference to FIGS. 1 to 3 are for use in selecting either of the linearly polarised signals. As explained above, however, signals may be received with circular polarisation, that is, circularly polarised in either sense. In order to enable circularly polarised signals to be selected a polariser having the form shown in block diagram configuration in FIG. 4 may be used.

Figure 4:
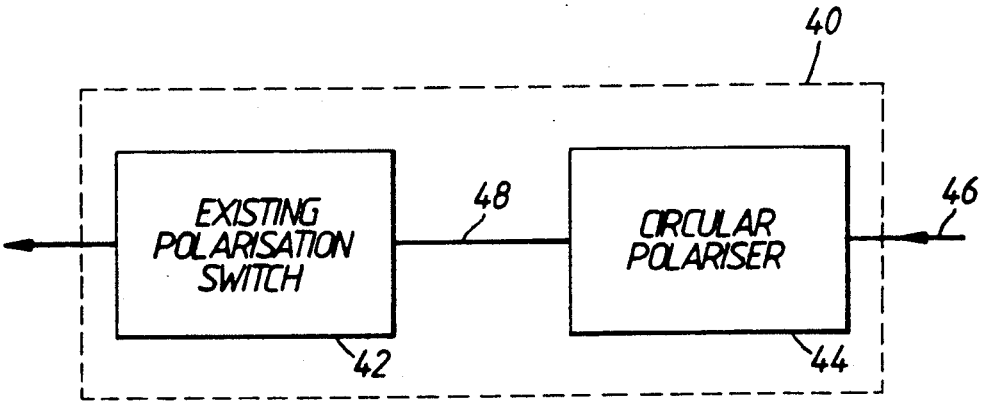
FIG. 4 is a block diagram of modified form of rotator for use when both linearly and circularly polarised signals may be received.

The polariser 40 shown in FIG. 4 comprises a polarisation switch 42 for selecting horizontally or vertically polarised signals and which may take the form shown in FIG. 2 or in FIG. 3 for example. The polarisation switch 42 is connected in series with a circular polariser 44. Circular polariser 44 comprises a polariser which converts circular polarisation to linear polarisation. The circular polariser 44 may be of the quarter-wave dielectric plate type, for example. This operates by converting one sense of circular polarisation into one form of linear polarisation and the other sense of circular polarisation into orthogonal linear polarisation. Incoming signals from the antenna are received on a line 46. Therefore, if such signals are circularly polarised in both senses, the circular polariser 44 will produce, on an output line 48, correspondingly linearly polarised signals, that is, with both horizontal and vertical polarisation. Signals with one of these senses of linear polarisation are selected by the polarisation switch 42 in the manner already described, and are then passed to the low noise block 10 in the manner already explained (see FIG. 1). Any other suitable type of circular polariser can be used instead, such as a corrugated waveguide or a waveguide with a suitably stepped internal configuration.

The circular polariser 44 is arranged (such as by appropriate alignment of its quarter wave plate) such that an incoming horizontally or vertically polarised signal is phase-shifted; its polarisation is not changed.

Figure 5:
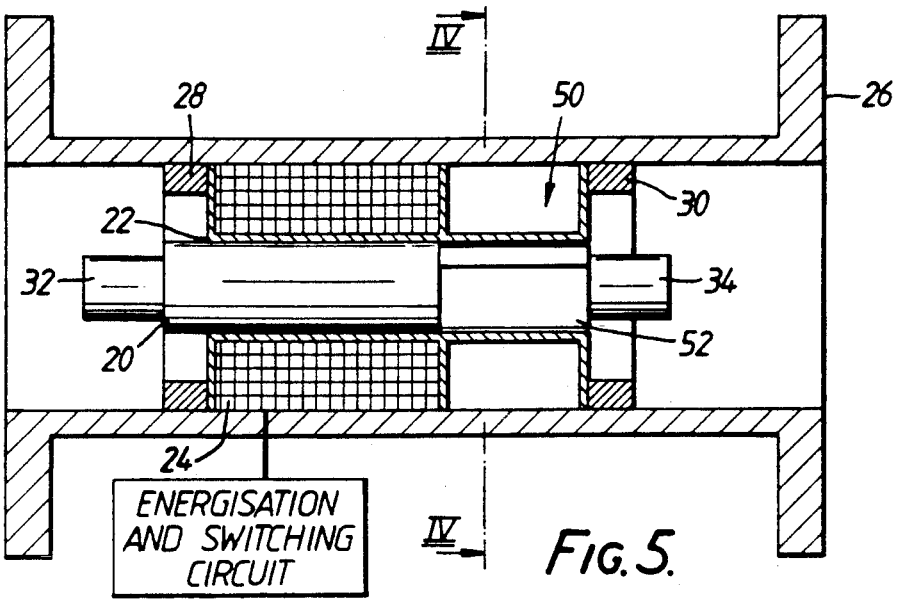
FIG. 5 is a cross-section through a rotator implementing the principles illustrated in FIG. 4.

FIG. 5 shows a polariser embodying the principles described with reference to FIG. 4. The polariser of FIG. 5 has some similarities with that described with reference to FIG. 3, and corresponding items are correspondingly referenced.

Figure 6:
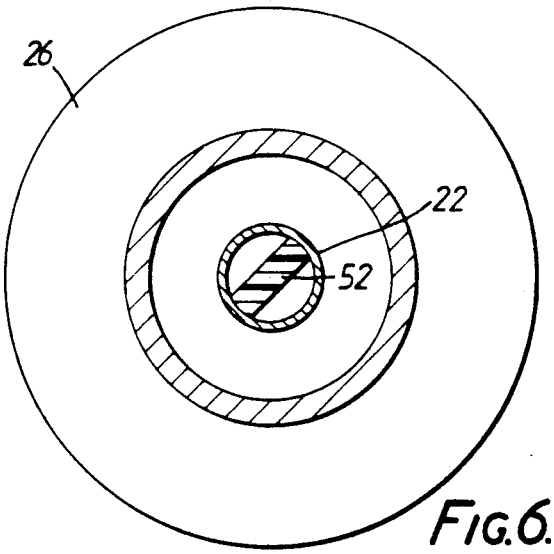
FIG. 6 is a diagrammatic cross-section on the line VI—VI of FIG. 5.

The arrangement of FIG. 5 corresponds to that of FIG. 3 except that a circular polariser 50, for performing the function of the circular polariser 44 of FIG. 4, is mounted at one end of the ferrite rod 20. The circular polariser 50 comprises a dielectric vane 52 which is mounted in an extension of the former 22, the former being made of metal or metallised so as to constitute the waveguide which is thereby extended over the dielectric vane 52. FIG. 6 shows the orientation of the dielectric vane 52 within the waveguide, this orientation being such that received horizontally or vertically polarised signals are merely phase-shifted (their polarisation being unchanged), while (as explained above) circularly polarised signals are converted into horizontally or vertically polarised signals. In practice the dielectric vane 52 is likely to be in three-part form with material of one dielectric material sandwiched between dielectric material of differing dielectric constant (and which could be air). Instead of a dielectric vane, a reduction in the waveguide cross-section could be used.

Figure 7:
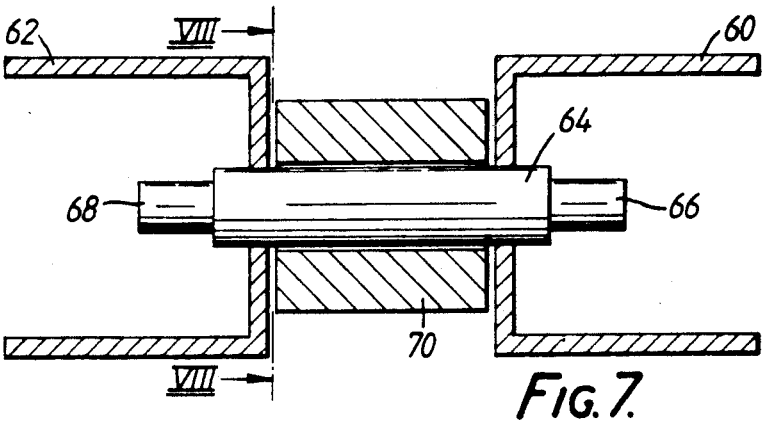
FIG. 7 is a diagrammatic cross-section through a modified rotator for implementing the principles illustrated in FIG. 4.

FIG. 7 shows a further form of polarisation switch which is capable of carrying out the functions illustrated in block diagram form in FIG. 4.

As shown in FIG. 7, the arrangement comprises an input waveguide housing 60 and an output waveguide housing 62. A metallised ferrite rod 64 extends between the input and output waveguide housings 60,62. The metallisation on the ferrite rod 64 constitutes the waveguide, and ceramic transformers 66,68 connect the waveguide into the waveguide housings 60,62.

The metallised ferrite rod 64 is mounted within a quadropole field section 70. This can be made of extruded ferrite and its construction is shown most clearly in FIG. 8. As illustrated there, the extruded ferrite constituting the field section 70 forms four poles 72,74,76 and 78 which are connected in a magnetic circuit by the extruded ferrite, the ferrite carrying electrically energisable coils 80,82,84 and 86.

Figure 8:
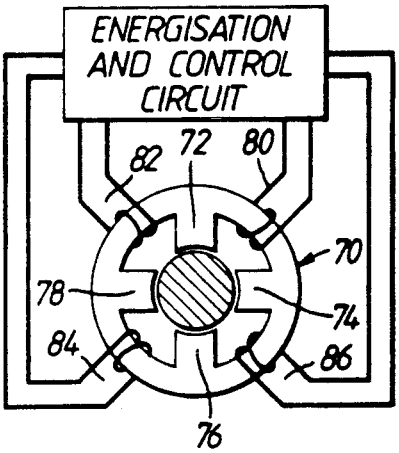
FIG. 8 is a cross-section on the line VIII—VIII of FIG. 7.

The operation of the polariser of FIGS. 7 and 8 is illustrated in FIGS. 9A to 9D. The operation depends on the sense and magnitude of the current in the coils 80 to 86.

Figure 9A:
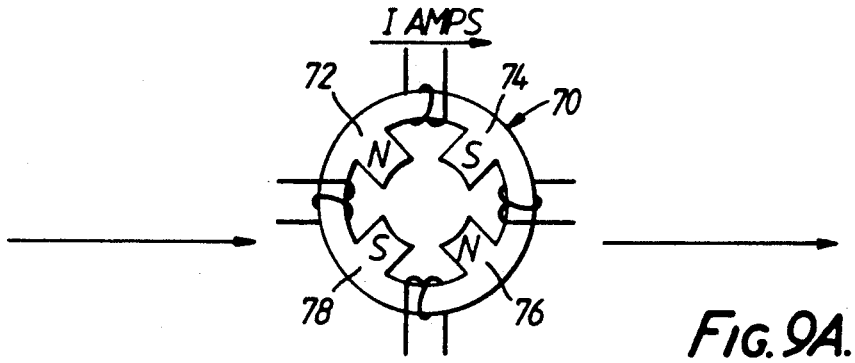
FIGS. 9A to 9D illustrate the operation of the polariser of FIGS. 7 and 8 under different operating conditions.

FIG. 9A shows the situation when the current in the coils has a predetermined value I and a sense such that poles 72 and 76 are North poles and poles 74 and 78 are South poles. In such a situation, incoming signals which are circularly polarised in a righthand sense are converted into vertically polarised outward signals.

Figure 9B:
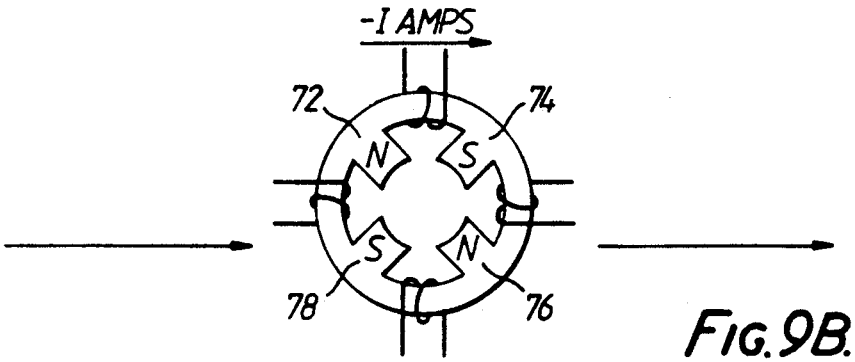

If the current in the coils is reversed in direction but maintained at the same predetermined value I, the magnetic polarisation of the poles is reversed to that shown in FIG. 9B. In such a situation, incoming signals which are circularly polarised in a lefthand sense are converted into vertically polarised output signals.

Figure 9C:
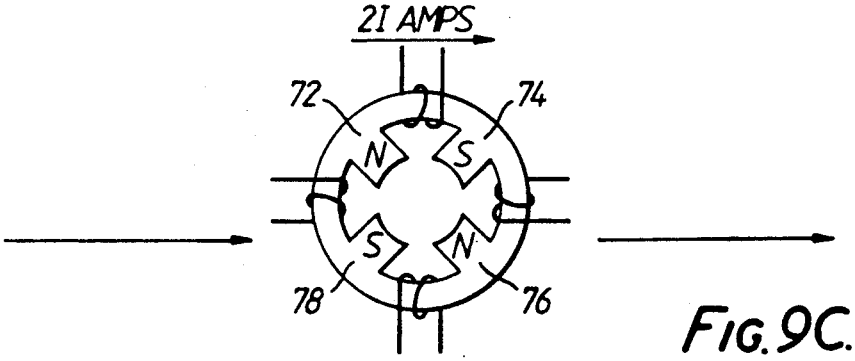

If the magnitude of the current is increased to 2I and has a direction corresponding to that for FIG. 9A, the magnetic poles are polarised as shown in FIG. 9C. In this situation, incoming signals which are horizontally polarised are converted to outgoing vertically polarised signals.

Figure 9D:
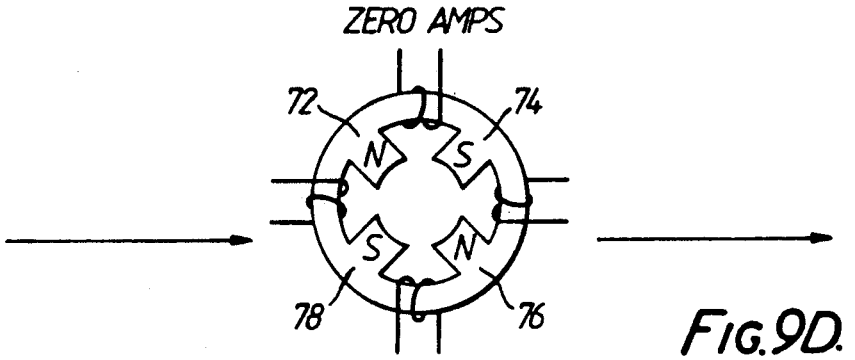

If there is no current in the coils, the situation is as shown in FIG. 9D: incoming vertically polarised signals pass through unchanged and leave as vertically polarised signals.

What is claimed is:

1. A polarisation switching arrangement responsive to polarised radio signals and capable of selecting signals having either one of predetermined states of linear polarisation comprising, a waveguide, a ferrite rod having a longitudinal axis and having flat end surfaces normal to the longitudinal axis, a dielectric support means axially and dielectrically supporting the ferrite rod in the waveguide, electrically energisable field generating means for generating a magnetic field directed axially along the ferrite rod and energisation means for supplying electrical current to the electrically energisable field generating means whereby to control energisation of the field generating means so as to switch the plane of linear polarisation in the waveguide between two positions which are orthogonal to each other, the dielectric support means comprising a dielectric holder directed axially of the waveguide and whose opposite axial ends are of stepped configuration and the opposite axial ends of the ferrite rod projecting axially beyond the opposite axial ends of the dielectric holder so as to be situated externally of the dielectric holder, whereby the combination of the stepped configuration of the opposite axial ends of the dielectric holder and the projecting ends of the ferrite rod compensates for the loading effect of the ferrite rod on the waveguide.

2. An arrangement according to claim 1, in which the field generating means comprises an electrical coil wound exteriorly around the waveguide and in axial alignment with the ferrite rod.

3. An arrangement according to claim 1, in which the waveguide is circular in cross-section and incorporates, at its output end, an integral circular-to-rectangular waveguide transducer for connection to a rectangular waveguide.

4. An arrangement according to claim 1, including, at the input end of the said waveguide, a feedhorn for receiving the signals from an antenna means.

5. An arrangement according to claim 4, in which the feedhorn is integral with the waveguide.

6. An arrangement according to claim 1, in which the energisation means includes means to reverse the direction of current applied to the field generating means so as to switch the plane of linear polarisation between one position at +45° with reference to the datum position existing when the field generating means is not being supplied with electrical current and a second position at −45° with reference to the datum position.

7. An arrangement according to claim 1, suitable for use where the polarised radio signals are circularly polarised signals of either sense, in combination with input means comprising circular polarising means for converting circularly polarised signals into one or other of the said states of linear polarisation according to the sense of circular polarisation.

8. An arrangement according to claim 7, in which the circular polarising means is a quarter-wave dielectric plate.

* * * * *